United States Patent [19]

Sumimoto

[11] 3,967,345

[45] July 6, 1976

[54] BINDING STRAP

[75] Inventor: Yasukichi Sumimoto, Tokyo, Japan

[73] Assignee: Tokyo Style Company, Ltd., Tokyo, Japan

[22] Filed: Feb. 7, 1975

[21] Appl. No.: 548,170

[52] U.S. Cl. ..... 24/16 PB
[51] Int. Cl.[2] ..... B65D 63/00
[58] Field of Search ..... 24/16 PB, 17 AP, 30.5 P, 24/73 PB, 206 A; 248/74 PB

[56] References Cited

UNITED STATES PATENTS

| | | | |
|---|---|---|---|
| 3,542,321 | 11/1970 | Kahabka | 248/74 PB X |
| 3,576,054 | 4/1971 | Rynk | 24/16 PB |
| 3,588,962 | 6/1971 | Feldberg | 24/16 PB |
| 3,735,448 | 5/1973 | Waddington | 24/16 PB |
| 3,872,547 | 3/1975 | Caveney et al. | 24/16 PB |

FOREIGN PATENTS OR APPLICATIONS

| | | | |
|---|---|---|---|
| 1,468,567 | 12/1966 | France | 24/30.5 P |

*Primary Examiner*—Donald A. Griffin
*Attorney, Agent, or Firm*—Armstrong, Nikaido & Wegner

[57] ABSTRACT

The present invention relates to a binding strap which includes a head portion with a strap body extending therefrom. The head portion includes a strap body insertion hole at the center thereof. A tongue, having a flat bottom face, is joined to the inner wall of the insertion hole by a flexible junction. A support means faces the bottom face of the tongue, and saw teeth are formed on one face of the tongue. The strap body has saw blade teeth on one face thereof for engaging the teeth of the tongue, thus holding the strap body within the head portion.

4 Claims, 12 Drawing Figures

BINDING STRAP

BACKGROUND OF THE INVENTION

1. Field of the Invention

This invention relates to the binding straps used for tightly binding wires, pouches etc. and is particularly concerned with the improvement of the binding straps mostly used for binding electric cables.

2. Description of the Prior Art

Binding straps made of metal or synthetic resin generally used for the abovementioned purposes and synthetic resin binding straps made of nylon, polyethylene etc. are in general use except for large or especially heavy articles. Synthetic resin straps are characterized in that they are quite easy to manufacture, suitable for mass production, and easily made into various kinds of shape. In particular, nylon binding straps have recently been used for binding electric cables in the fields of computors, automatic control electric apparatus, motorcars and others, since they are excellent in electric characteristics as well as in strength and formability. This invention relates to the improvement of binding straps which are entirely formed in one body with synthetic resin.

Binding straps have to present various characteristics and it is positively necessary for them to be easy to handle and to bind up and excellent in binding strength. Generally, handling is mutually contradictory to binding strength, that is, the easier to handle the strap structure is, the lower the binding strength thereof becomes. Accordingly, laborious researches have been conducted in order to obtain the binding straps with possess both advantages, but sufficient straps have not been brought about so far.

FIG. 12 shows an example of a head portion of a conventional binding strap. A strap body 31 extends from the side of the head portion 30 and a tongue 34 is connected to a base portion 35 toward inner side 33 of a strap body insertion hole 32 formed at the center of the head portion 30.

When the above binding strap is used to tie up electric cables 40 etc. as shown in FIG. 1, the strap body 31 is adapted to encircle the cables 40 and the forward end thereof is inserted through the hole 32 and pulled. Then, the strap body 31 is fastened to the head portion 30 with the engagement of saw blade teeth 36 provided on the strap body 31 with saw blade teeth 37 provided on the tongue 34.

As seen from FIG. 12, since the tongue 34 bends about the base portion 35 as a fulcrum, it moves in the direction of arrow A when the strap body 31 is inserted in the direction of arrow C through the hole 32. Tongue 34 moves in the direction of arrow B when tension acts in the direction of arrow D on the strap body 31. Therefore, it is necessary to decrease the strength of the base portion 35 to facilitate the insertion of the strap body 31 through the insertion hole 32. However, the strength of the base portion 35 must not be decreased beyond a certain limit, because the force of the tongue 34 pressing the strap body 31 will become to small. Besides, the simultaneous engagement of a number of teeth 36 with teeth 37 cannot be assured if the tongue 34 is too flexible. In order to engage a number of eeth 36 with teeth 37 simultaneously, the teeth 36 must correspond accurately and closely to the teeth 37. However, in the strap as shown in FIG. 12, the teeth engagement is not sufficient since the tongue moves in the direction of arrow A – B in FIG. 12.

Another prior art strap such as in U.S. Pat. No. 3,588,962 includes the binding strap wherein the base portion of the tongue is made narrower to make it easier to bend a tongue 34. The strap of this type has drawbacks in that the metal mold for molding the binding straps is too complicated, with the result that productivity is astonishingly lowered and sufficient binding strength cannot be obtained since such strength is attributable to the strength of the base portion of the tongue. As desired above, in prior art devices the binding straps with a structure which facilitated handling had drawbacks in that the binding strength was weakened and formability became worse.

Objects of the invention

This invention is intended to eliminate the drawbacks of the abovementioned prior arts and its objects are:

1. to provide binding straps wherein a strap body can be smoothly inserted through an insertion hole with very low resistance;
2. to provide binding straps wherein a number of tongue teeth securely and simultaneously engage with a number of strap body teeth when the strap is used; and
3. to provide binding straps wherein a tongue is supported by a large base portion so that high resistance is given when the strap is used.

BRIEF SUMMARY OF INVENTION

The binding strap in accordance with this invention is characterized in that a tongue and a head portion are joined by a narrow junction and a tongue support is arranged at the bottom of the tongue.

DETAILED DESCRIPTION OF THE EMBODIMENTS

Figure 1:
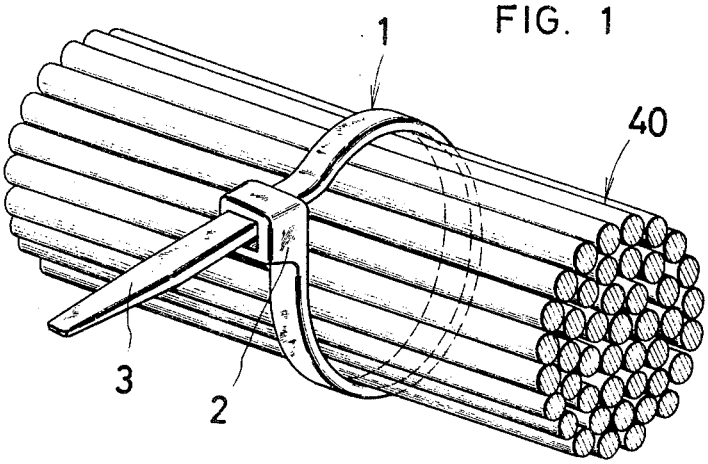
FIG. 1 is a perspective view showing a binding strap to tie up electric cables.

Referring now to the drawings in which like reference numerals designate like or corresponding parts throughout, there is shown a binding strap 1 which comprises a head portion 2 and a strap body 3. A strap body insertion hole 4 is arranged at the center of the head portion 2 and a tongue 5, which serves as a stopper, extends toward the hole 4. The tongue 5 is flexibly supported on the wall of the insertion hole 4 by a junction 6. The tongue 5 has a flat bottom face 5*a* and a support 8 is arranged below the bottom face 5*a* with a narrow slit 7 there between. The support 8 is arranged in order to support the tongue against the force acting on the tongue 5 when the strap body 3 is stretched and the support 8 has to be thick enough to support the tongue against the force. The distancce between the forward end face 8*a* of the support 8 and the wall 4*a* of the strap body insertion hole 4 is slightly larger than the thickness of the strap body 3 so that the strap body 3 is tightly inserted through the hole 4.

The narrow slit 7 is provided between the tongue 5 and the support 8 to separate the tongue 5 from the support 8. The narrower the slit is, the less the tongue moves and the more securely the tongue 5 engages with the strap body 3. The slit 7 is formed with a separating plate in the metal mold for producing the binding straps. The shape and direction of the slit 7 depends on the direction of the insertion and the pull of the moving separating plate.

Figure 2:
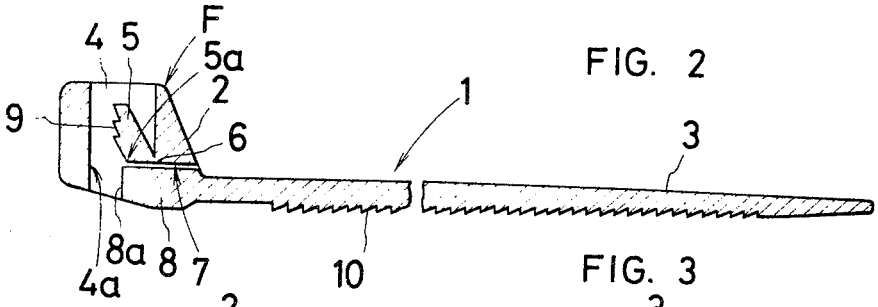
FIG. 2 is a sectional side view of a binding strap according to a first embodiment of this invention.
Figure 3:
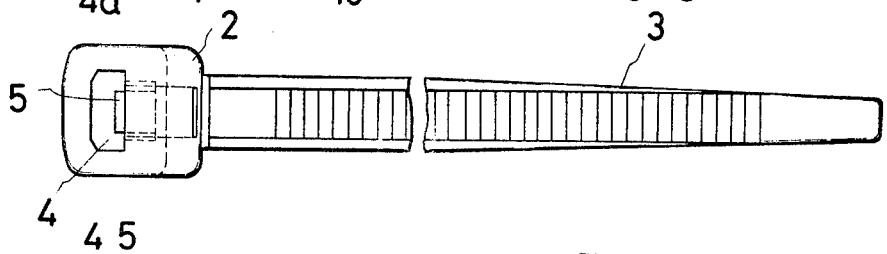
FIG. 3 is a front view of the binding strap shown in FIG. 1.
Figure 4:
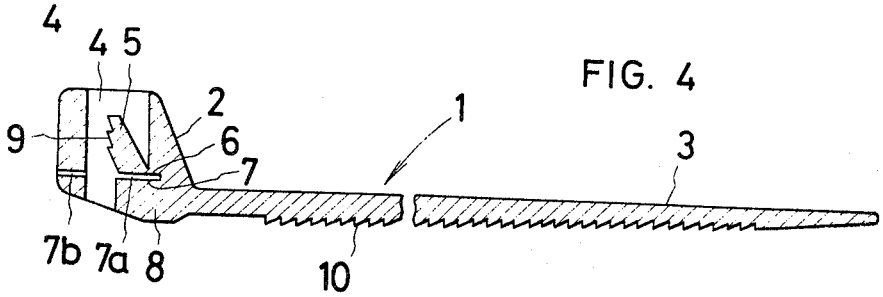
FIG. 4 is a sectional side view of a binding strap according to a second embodiment.
Figure 5:
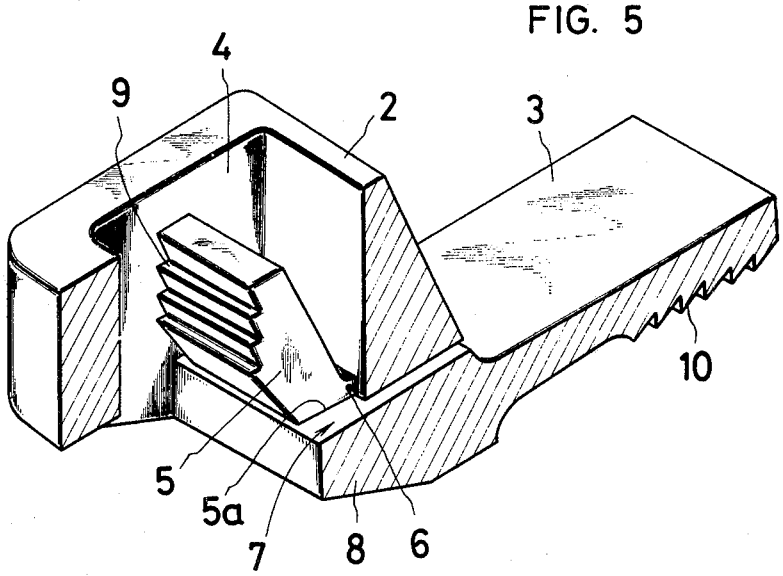
FIG. 5 is a partially sectional view of the head portion of the strap according to the first embodiment shown in FIG. 2.

The slit 7 as shown in FIG. 2 is formed with a metal mold where the separating plate is inserted from and pulled out toward the strap body side. The slits 7*a* and 7*b* as shown in FIG. 4 are formed where the plate is inserted to the end 7*d* and pulled out toward the forward side of the head portion 2.

This invention is characterized in that the bottom 5*a* of the tongue 5 is separated from the support 8 and that the tongue is supported with a flexible junction 6 so it can be bent with ease. Preferably, the width of the slit 7 is as narrow as possible so that the strength of the head portion and the binding strength can be increased.

Figure 6:
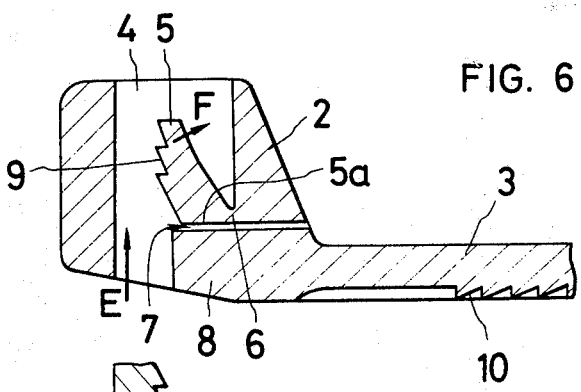
FIGS. 6 and 7 are sectional side views illustrating the operation of the strap according to the first embodiment shown in FIG. 2.

FIG. 6 shows a section of a strap head portion in accordance with this invention. When no force is acting on the tongue 5, a gap 7 is maintained between the tongue 5 and the support 8. When the strap body 3 is inserted in the direction of arrow E through the strap body insertion hole 4 from the under side, the tongue 5 bends is the direction of arrow F. At this point, there is almost no resisting force to prevent the strap body 3 from being inserted through insertion hole 4 because the tongue 5 is joined to the inner wall of the head portion 2 by the junction 6.

Figure 7:
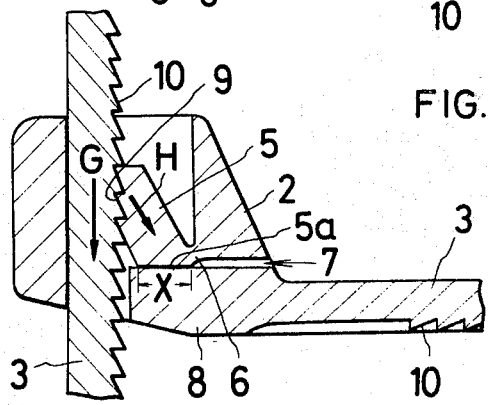

Next, a tension acts on the strap body 3 in the direction of arrow G as shown in FIG. 7, and then, the bottom face 5*a* of the tongue 5 abuts on the upper face of the support 8 due to the engagement between teeth 9 and 10. This condition is quite important. A component of the force to move the strap body 3 in the direction of arrow G, that is, a component of the tension generated when binding the article presses the wall of head portion 2 via the junction 6, while most of the tension shown by arrow H acts on the support 8. Accordingly, the bottom face 5*a* of the tongue 5 abuts the support 8 as if the tongue 5 is integral with the support 8, and thus the tongue resists the force acting on the strap body 3.

Figure 12:
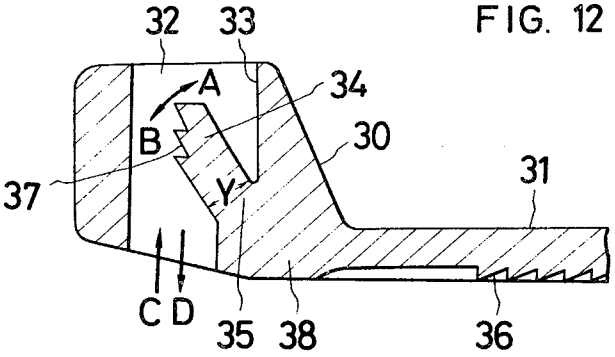
FIG. 12 is a sectional side view of the head portion of a conventional binding strap.

In the case of the conventional binding strap as described hereinbefore with reference to FIG. 12, it was impossible to make the width Y of the root of the tongue 5 very wide, because it was necessary to give the tongue itself sufficient flexibility. As a result, it was impossible greatly increase the tension acting on the strap body. On the contrary, in this invention, since it is possible to freely select the width X of the bottom face

5a of the tongue 5 as shown in FIG. 7 and since it is possible to make the tongue itself larger so as to receive the entire tension acting on the strap body 3, the binding strength can be made very high. Besides, although a slight compression force acts on the junction 6, no shearing force due to the binding force acts on it. Therefore, it is possible to make the junction quite narrow and the tongue 5 is easier to bend.

Figure 8:
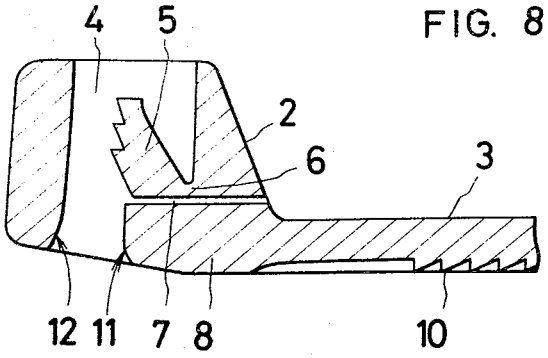
FIG. 8 is a sectional side view of the head portion of a binding strap according to a third embodiment.

FIG. 8 shows another embodiment of this invention wherein the entrance portion of the insertion hole 4 arranged in the head portion 2 has curved faces 11 and 12 so that the strap body 3 is easily inserted through the hole 4. Such construction is especially effective for the binding straps of smaller size.

Since the binding strap according to this invention is constructed as described above, almost no resisting force acts when the strap body 3 is inserted through the strap body insertion hole 2 arranged in the head portion 2. And since the bottom face 5*a* of the tongue 5 abuts closely on the support 8 as if the tongue 5 and the support 8 are made in one body, the tongue 5 can support a very high tension. Moreover, in accordance with this invention, it is possible to increase the number of saw blade teeth 9 and accordingly it becomes possible to make the width X of the bottom face 5*a* larger. Therefore, the binding strap is suitable for high tension and stable binding can be obtained.

Figure 9:
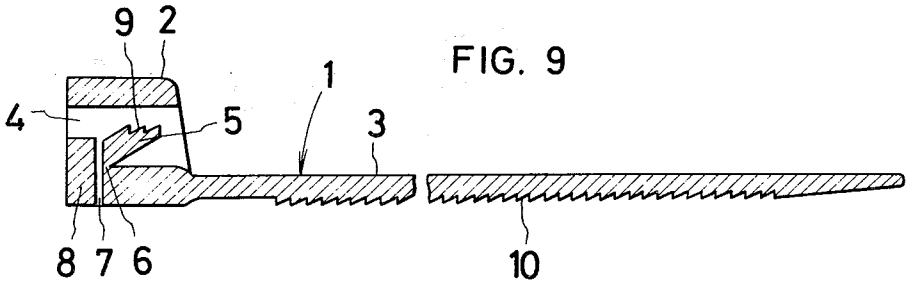
FIG. 9 is a sectional side view of a binding strap according to a fourth embodiment.
Figure 10:
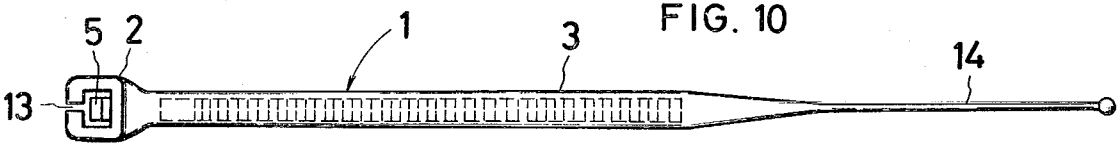
FIG. 10 is a rear view of a binding strap according to the fifth embodiment.
Figure 11:
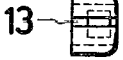
FIG. 11 is a left side view of the binding strap shown in FIG. 10.

This invention is applicable not only to the binding straps as described in the above embodiments but also to a binding strap that is provided with a slit 13 at the center of the head portion 2 as shown in FIGS. 10 and 11, through which the narrower bristle-like forward end portion of the strap body 3 is inserted from left side of FIG. 2 and then pulled so as to easily encircle the strap body around the around the article to be bundled.

Where the strap body 3 is arranged parallel to the insertion hole 4 as shown in FIG. 9, the head portion becomes parallel to the strap body when the binding strap encircles a bundle of electric cables and the like, and thus, compact binding can be effected.

What is claimed is:

1. A binding strap comprising a head portion and a strap body extending from said head portion, said head portion comprising: A. a strap body insertion hole at the center thereof;

B. a tongue joined to an inner wall of said insertion hole by a flexible junction, the bottom face of said tongue being flat;

C. a support means facing said bottom face of the tongue;

D. there being slit between said support means and said bottom face of the tongue, said slit passing through said head portion between said strap body insertion hole and the exterior of said head; and E. saw blade teeth formed on one face of said tongue, wherein said strap body has saw blade teeth on one face thereof for engaging said teeth of the tongue to hold said strap within said head portion.

2. The binding strap of claim 1, wherein said slit is perpendicular to the axis of said strap body insertion hole.

3. The binding strap of claim 2, wherein the axis of said strap body insertion hole is perpendicular to said strap body.

4. The binding strap of claim 2, wherein the axis of said strap body insertion hole is parallel to said strap body.

* * * * *